US009945015B2

(12) United States Patent
Yuga et al.

(10) Patent No.: US 9,945,015 B2
(45) Date of Patent: Apr. 17, 2018

(54) HIGH-TENSILE STEEL PLATE GIVING WELDING HEAT-AFFECTED ZONE WITH EXCELLENT LOW-TEMPERATURE TOUGHNESS, AND PROCESS FOR PRODUCING SAME

(71) Applicant: JFE Steel Corporation, Tokyo (JP)

(72) Inventors: Masao Yuga, Chita (JP); Shigeki Kitsuya, Kurashiki (JP); Kenji Hayashi, Kurashiki (JP); Minoru Suwa, New York, NY (US)

(73) Assignee: JFE Steel Corporation, Tokyo (JP)

( * ) Notice: Subject to any disclaimer, the term of this patent is extended or adjusted under 35 U.S.C. 154(b) by 1036 days.

(21) Appl. No.: 14/349,209

(22) PCT Filed: Oct. 1, 2012

(86) PCT No.: PCT/JP2012/006269

§ 371 (c)(1),
(2) Date: Apr. 2, 2014

(87) PCT Pub. No.: WO2013/051231

PCT Pub. Date: Apr. 11, 2013

(65) Prior Publication Data

US 2014/0246131 A1 Sep. 4, 2014

(30) Foreign Application Priority Data

Oct. 3, 2011 (JP) ..... 2011-219307

(51) Int. Cl.

| | |
|---|---|
| ***C22C 38/00*** | (2006.01) |
| ***C22C 38/42*** | (2006.01) |
| ***C21D 8/02*** | (2006.01) |
| ***C22C 38/58*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/50*** | (2006.01) |
| ***C22C 38/54*** | (2006.01) |
| *C21D 9/50* | (2006.01) |

(52) U.S. Cl.

CPC ..... *C22C 38/42* (2013.01); *C21D 8/02* (2013.01); *C21D 8/0205* (2013.01); *C21D 8/0263* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/50* (2013.01); *C22C 38/54* (2013.01); *C22C 38/58* (2013.01); *C21D 9/50* (2013.01)

(58) Field of Classification Search

CPC ..... C22C 38/42; C21D 8/0205

See application file for complete search history.

(56) References Cited

U.S. PATENT DOCUMENTS

2011/0036469 A1 2/2011 Furuya et al.

FOREIGN PATENT DOCUMENTS

| | | | |
|---|---|---|---|
| EP | 0 861 915 | | 9/1998 |
| JP | 57-009854 | | 1/1982 |
| JP | 57-079117 | A | 5/1982 |
| JP | 3-053367 | | 8/1985 |
| JP | 60-184663 | | 9/1985 |
| JP | 62-093346 | | 4/1987 |
| JP | 2-133521 | A | 5/1990 |
| JP | 05-186823 | | 7/1993 |
| JP | H08176724 | A | 7/1996 |
| JP | 8-283899 | A | 10/1996 |
| JP | 09-001303 | | 1/1997 |
| JP | 11-229077 | | 8/1999 |
| JP | 2001-011566 | A | 12/2001 |
| JP | 2001-335884 | A | 12/2001 |
| JP | 2003-147484 | | 5/2003 |
| JP | 2005-068478 | | 3/2005 |
| JP | 2008-169429 | A | 7/2008 |
| JP | 2010-229453 | A | 10/2010 |
| JP | 2011-202214 | A | 10/2011 |
| WO | WO 2005/061749 | | 7/2005 |
| WO | WO 2011/096456 | | 8/2011 |

OTHER PUBLICATIONS

European Office Action for Application No. 12 838 748.7, dated May 12, 2016, 19 pages.

Y. Shen, S.S. Hansen, Development of a 100 ksi (690 Mpa) Yield Strength, Weathering Steel for Bridge Applications, High Perform Struct Steels, 1995, p. 127-134.

International Search Report dated Dec. 25, 2012, application no. PCT/JP2012/006269.

European Search Report for Application No. EP 12 83 8748 dated May 21, 2015.

European Office Action for European Application No. 12 838 748.7, dated Jun. 27, 2017, 6 pages.

European Communication for European Application No. 12 838 748.7, dated Jan. 16, 2016, 6 pages.

*Primary Examiner* — Jessee Roe
*Assistant Examiner* — Alexander Polyansky
(74) *Attorney, Agent, or Firm* — RatnerPrestia

(57) ABSTRACT

A high-tensile steel plate has a chemical composition containing, by mass, specific amounts of C, Mn, Si, P, S, Al, Ni, B, N, one or more elements selected from Cr, Mo, V, Cu, Ti, and Ca as needed, Ceq≤0.80, and a center-segregation zone hardness index HCS satisfying $5.5[C]^{4/3}+15[P]+0.90[Mn]+0.12[Ni]+0.53[Mo]\leq 2.5$. The hardness of a center-segregation zone satisfies $HV_{max}/HV_{ave}\leq 1.35+0.006/C-t/750$. A steel having the above-described chemical composition is subjected to hot rolling at a specific slab-heating temperature at a specific rolling reduction ratio, subsequently reheated, cooled at a cooling rate of 0.3° C./s or more until the temperature of a central portion in a plate-thickness direction reaches 350° C. or less, and tempered to a specific temperature range.

8 Claims, No Drawings

HIGH-TENSILE STEEL PLATE GIVING WELDING HEAT-AFFECTED ZONE WITH EXCELLENT LOW-TEMPERATURE TOUGHNESS, AND PROCESS FOR PRODUCING SAME

CROSS REFERENCE TO RELATED APPLICATIONS

This is the U.S. National Phase application of PCT International Application No. PCT/JP2012/006269, filed Oct. 1, 2012, and claims priority to Japanese Patent Application No. 2011-219307, filed Oct. 3, 2011, the disclosures of each of these applications being incorporated herein by reference in their entireties for all purposes.

FIELD OF THE INVENTION

The present invention relates to a high-tensile steel plate used for steel structures such as ships, marine structures, pressure vessels, and penstocks and to a method for producing the high-tensile steel plate. In particular, the present invention relates to a high-tensile steel plate having a yield point of 620 MPa or more and realizing high low-temperature toughness of a multipass welded zone formed by low-to-medium heat input welding as well as high base-material strength and toughness and to a method for producing the high-tensile steel plate.

BACKGROUND OF THE INVENTION

Steel used for ships, marine structures, and pressure vessels is formed into a structure having a desired shape by weld bonding. Therefore, it is required that such steel realize high toughness of welded joint portions (e.g., weld metal and heat affected zone) as well as, needless to say, high base-material strength and toughness from the viewpoint of safety of structures.

Hitherto, absorbed energy determined by a Charpy impact test has been mainly used as a standard for evaluating the toughness of steel. In order to enhance reliability, recently, a crack tip opening displacement test (hereinafter, referred to as "CTOD test") has been commonly employed. A CTOD test evaluates resistance to brittle fracture by performing three-point bending of a test piece having a fatigue crack formed in a toughness evaluation portion and then measuring an opening displacement at the crack tip immediately prior to fracturing.

Since a CTOD test utilizes a fatigue crack, a very minute region serves as a toughness evaluation portion. Thus, if a local brittle zone is present, low toughness may be measured by a CTOD test even though high toughness is measured by a Charpy impact test.

A local brittle zone is likely to be formed in a weld heat affected zone (HAZ) that is subjected to a complex thermal history due to multipass welding of a thick steel plate or the like. A bonded portion (interface between a weld metal and a base material) and a portion in which the bonded portion is reheated to form a dual-phase region (portion in which coarse particles are formed in the first weld cycle and a dual-phase region of ferrite and austenite is formed due to heating by the following weld path, hereinafter, referred to as "dual-phase-region reheated portion") may become a local brittle zone.

A bonded portion is subjected to a high temperature near its melting point, which increases the size of austenite grains, and is likely to be caused to be transformed into an upper bainite structure having low toughness by the subsequent cooling. Therefore, the matrix itself has low toughness. In addition, brittle structures such as a Widmannstatten structure and a martensite-austenite constituent are likely to be formed in a bonded portion, which causes further degradation of toughness.

In order to enhance the toughness of a bonded portion, for example, a technique in which TiN is finely dispersed in steel and thereby an increase in the size of austenite grains is suppressed or the dispersed TiN is utilized as ferrite transformation cores has been in practical use.

Patent Literatures 1 and 2 disclose a technique of enhancing welded portion toughness by adding a rare-earth metal (REM) to steel in combination with Ti, dispersing fine particles in the steel, and thereby suppressing growth of austenite grains.

In addition, a technique in which an oxide of Ti is dispersed, a technique in which ferrite-core formation capacity of BN is utilized in combination with dispersing of an oxide, and a technique of enhancing toughness by adding Ca and REM and thereby controlling the form of a sulfide are described.

Patent Literature 3 proposes a V-free refined high-tensile steel because, in the case of multipass welding, a brittle zone due to precipitation hardening of V, which is a precipitation-type element, serves as a local brittle zone in a CTOD test and this reduces a critical CTOD value.

However, the above techniques are intended for steel materials having a relatively low strength and less amounts of alloy elements and are not applicable to steel materials having a high-tensile and large amounts of alloy elements because, in this case, a HAZ microstructure does not include ferrite.

Patent Literature 4 discloses a technique for promoting formation of ferrite in a weld heat affected zone mainly by increasing the amount of Mn added to 2% or more. Patent Literature 5 describes a technique for improving CTOD characteristics (CTOD toughness) of a HAZ by making the microstructure of a weld heat affected zone finer by employing a high-Mn type chemical composition, controlling the amount of oxygen to an appropriate value, and thereby increasing the number of intra-granular transformation ferrite cores as well as by controlling a value of a parametric expression consisting of brittle elements such as C, Nb, and V.

However, alloy elements such as Mn are likely to segregate at the center of a slab in a continuous-cast material. This increases the hardness of a center-segregation zone in a weld heat affected zone as well as in a base material and the center-segregation zone becomes a starting point of fracturing. As a result, base-material toughness and HAZ toughness become degraded.

Patent Literature 6 proposes a technique in which a strand having no center segregation is produced by reducing the thickness of the strand by pressing the strand with a plane during solidification subsequent to continuous casting and a microstructure in the vicinity of a weld bonded portion is improved using a complex oxide.

Patent Literature 7 proposes a technique of designing components by determining an average analytical value of the components contained in a microscopic region including segregation of the central portion in a plate-thickness direction located at a position corresponding to the center of a slab and thereby deriving a segregation parametric expression.

In a dual-phase-region reheated portion, carbon concentrates at a region that has reverse-transformed into austenite due to dual-phase-region reheating and thereby a vulnerable bainite structure including a martensite-austenite constituent is formed during cooling, which causes degradation of toughness. Patent Literatures 8 and 9 disclose a technique in which toughness is improved by setting a steel chemical composition to contain low C and low Si and thereby suppressing formation of a martensite-austenite constituent and base metal strength is maintained by adding Cu. In the above technique, strength is increased by precipitation of Cu through an aging treatment, and a large amount of Cu is added. This causes degradation of hot ductility and accordingly deteriorates productivity.

As described above, various factors affect CTOD characteristics. Thus, Patent Literature 10 proposes a steel material with which good CTOD characteristics of a multipass welded zone formed by low-to-medium heat input welding are realized. The steel material is produced by taking comprehensive measures such as control of slab-heating temperature for a continuous casting steel slab such that center segregation is reduced, control of the amount of B mixed into a steel chemical composition, and control of a chemical composition with which formation of a martensite-austenite constituent is suppressed.

Patent Literature 11 describes a technique for improving CTOD characteristics of a multipass welded zone formed with a welding heat input up to 100 kJ/cm at maximum by, in the case of large-heat input welding, making effective crystal grains that are units into which HAZ coarse grains are broken finer and, in the case of low-to-medium heat input welding, setting a chemical composition capable of improving grain boundary hardenability due to a reduction in the amount of a martensite-austenite constituent and addition of a trace amount of Nb, suppressing of precipitation hardening, and reducing the hardness of a HAZ.

PATENT LITERATURE

PTL 1: Japanese Examined Patent Application Publication No. 3-053367

PTL 2: Japanese Unexamined Patent Application Publication No. 60-184663

PTL 3: Japanese Unexamined Patent Application Publication No. 57-9854

PTL 4: Japanese Unexamined Patent Application Publication No. 2003-147484

PTL 5: Japanese Unexamined Patent Application Publication No. 2008-169429

PTL 6: Japanese Unexamined Patent Application Publication No. 9-1303

PTL 7: Japanese Unexamined Patent Application Publication No. 62-93346

PTL 8: Japanese Unexamined Patent Application Publication No. 5-186823

PTL 9: Japanese Unexamined Patent Application Publication No. 2001-335884

PTL 10: Japanese Unexamined Patent Application Publication No. 2001-11566

PTL 11: Japanese Unexamined Patent Application Publication No. 11-229077

SUMMARY OF THE INVENTION

In a jack-up rig used in recent marine structures, a steel material having a yield point of 620 MPa class and a plate thickness of 50 to 210 mm is used as a leg portion, a cantilever (beam of a drill portion), and the like. Therefore, good CTOD characteristics in a welded portion are requested. However, it is difficult to employ the techniques for improving the CTOD characteristics of a weld heat affected zone described in Patent Literatures 1 to 11 because the target yield point and/or plate thickness of a steel material are different.

Accordingly, the present invention aims to provide a high-tensile steel plate having a yield point of 620 MPa or more and realizing good CTOD characteristics of a weld heat affected zone in a multipass welded zone formed by low-to-medium heat input welding, which is suitably used for steel structures such as ships, marine structures, pressure vessels, and penstocks, and to provide a method for producing the high-tensile steel plate.

The inventors of the present invention have conducted extensive studies on a method for improving the toughness of a weld heat affected zone formed by multipass welding in order to maintain CTOD characteristics, that is, a critical CTOD value of 0.50 mm or more at a test temperature of −10° C. as well as maintaining base-material strength, that is, a yield point of 620 MPa or more, and base-material toughness.

As a result, the inventors have found the following effective methods: 1. suppressing an increase in the size of austenite grains in a weld heat affected zone; 2. dispersing transformation cores uniformly and finely in order to promote ferrite transformation upon cooling subsequent to welding; 3. controlling the amount of Ca, which is added in order to control the form of a sulfide, within an appropriate range in order to suppress formation of a brittle structure; and 4. controlling the contents of C, P, Mn, Nb, and Mo, which are brittle elements, within a appropriate range in order to improve the CTOD characteristics of a weld heat affected zone.

The present invention has been made by conducting further studies on the basis of the above findings and provides the following:

1. A high-tensile steel plate giving welding heat-affected zone with excellent low-temperature toughness, the high-tensile steel plate comprising a chemical composition containing, by mass, C: 0.05% to 0.14%, Si: 0.01% to 0.30%, Mn: 0.3% to 2.3%, P: 0.008% or less, S: 0.005% or less, Al: 0.005% to 0.1%, Ni: 0.5% to 4%, B: 0.0003% to 0.003%, N: 0.001% to 0.008%, Ceq (=[C]+[Mn]/6+[Cu+Ni]/15+[Cr+Mo+V]/5, each element symbol represents the content (mass %) of the element)≤0.80, a center-segregation zone hardness index HCS satisfying Expression (1), and the balance being Fe and inevitable impurities, wherein the hardness of a center-segregation zone in the steel plate satisfies Expression (2), $$HCS=5.5[C]^{4/3}+15[P]+0.90[Mn]+0.12[Ni]+0.53[Mo]\leq 2.5 \quad (1)$$

where each [M] represents the content (mass %) of the element, $$HV_{max}/HV_{ave}<1.35+0.006/C-t/750 \quad (2)$$

where $HV_{max}$ represents a maximum Vickers hardness of the center-segregation zone, $HV_{ave}$ represents an average Vickers hardness of a portion that does not include the center-segregation zone and that does not include regions extending from both surfaces to ¼ of the thickness of the steel plate, C represents the content (mass %) of carbon, and t represents a thickness (mm) of the steel plate.

2. The high-tensile steel plate giving welding heat-affected zone with excellent low-temperature toughness according to Claim 1, the chemical composition of the steel plate further containing one or more elements selected from, by mass, Cr: 0.2% to 2.5%, Mo: 0.1% to 0.7%, V: 0.005% to 0.1%, and Cu: 0.49% or less.

3. The high-tensile steel plate giving welding heat-affected zone with excellent low-temperature toughness according to Claim 1 or 2, the chemical composition of the steel plate further containing one or more elements selected from, by mass, Ti: 0.005% to 0.025% and Ca: 0.0005% to 0.003%.

4. A method for producing high-tensile steel plate giving welding heat-affected zone with excellent low-temperature toughness, the method comprising heating a steel having the chemical composition according to Claim 1 or 2 to 1050° C. or more, performing hot rolling at a rolling reduction ratio of 2 or more, performing reheating to 880° C. or more, performing cooling at a cooling rate of 0.3° C./s or more until a temperature of a central portion in a plate-thickness direction reaches 350° C. or less, and performing a tempering treatment at 450° C. to 680° C.

According to the present invention, a high-tensile steel plate having a yield point of 620 MPa or more and realizing high low-temperature toughness, in particular, good CTOD characteristics, of a multipass welded zone formed by low-to-medium heat input welding, which is suitably used for large steel structures such as a marine structure, and a method for producing the high-tensile steel plate can be produced and are very useful industrially.

DESCRIPTION OF EMBODIMENTS OF THE INVENTION

In the present invention, chemical composition and hardness distribution in a plate-thickness direction are specified.

1. Chemical Composition

The reasons for the limitations on the chemical composition are described. In the following description, "%" represents "mass %".

C: 0.05% to 0.14%

C is an element that is necessary in order to maintain base-material strength for a high-tensile steel plate. If the C content is less than 0.05%, hardenability becomes degraded, which requires addition of large amounts of elements that enhance hardenability, such as Cu, Ni, Cr, and Mo, in order to maintain strength. This leads to a high cost and degradation of weldability. On the other hand, if the amount of C added exceeds 0.14%, weldability becomes significantly degraded and the toughness of a welded zone becomes degraded. Thus, the C content is set to 0.05% to 0.14% and preferably set to 0.07% to 0.13%.

Si: 0.01% to 0.30%

Si is a component that serves as a deoxidizing element and that is added in order to maintain base-material strength. However, a large amount of Si exceeding 0.30% results in degradation of weldability and degradation of the toughness of a welded joint. Thus, it is necessary to set the Si content to 0.01% to 0.30%. Preferably, the Si content is 0.25% or less.

Mn: 0.3% to 2.3%

The amount of Mn added is 0.3% or more in order to maintain base-material strength and the strength of a welded joint. If the amount of Mn added exceeds 2.3%, weldability becomes degraded and hardenability becomes excessively enhanced, which results in degradation of base-material toughness and the toughness of a welded joint. Thus, the Mn content is set to 0.3% to 2.3%.

P: 0.008% or less

P is an impurity that is inevitably mixed into steel and causes base-material toughness and the toughness of a welded zone to be degraded. In particular, if the P content exceeds 0.008% in a welded zone, toughness becomes significantly degraded. Thus, the P content is set to 0.008% or less.

S: 0.005% or less

S is an impurity that is inevitably mixed into steel. If the S content exceeds 0.005%, base-material toughness and the toughness of a welded zone become degraded. Thus, the S content is set to 0.005% or less and preferably set to 0.0035% or less.

Al: 0.005% to 0.1%

Al is an element that is added in order to deoxidize molten steel, and it is necessary to set the Al content to 0.005% or more. However, if the amount of Al added exceeds 0.1%, base-material toughness and the toughness of a welded zone become degraded. Furthermore, Al is diluted due to welding and mixed into a weld metal zone, which causes toughness to be degraded. Thus, the Al content is limited to 0.1% or less and preferably limited to 0.08% or less.

Ni: 0.5% to 4%

Ni causes the strength and toughness of steel to be enhanced and is therefore effective for enhancing the low-temperature toughness of a welded zone. Thus, the Ni content is set to 0.5% or more. However, Ni is an expensive element and addition of an excessive amount of Ni causes hot ductility to be degraded, which increases of the risk of formation of flaws in the surface of a slab during casting. Thus, the upper limit is set to 4%.

B: 0.0003% to 0.003%

B segregates at the austenite grain boundary and suppresses the ferrite transformation starting from the grain boundary. Thus, addition of a trace amount of B produces an effect of enhancing the hardenability of steel. This effect is produced when the amount of B added is 0.0003% or more. However, if the B content exceeds 0.003%, B precipitates as a carbonitride or the like, which reduces hardenability and toughness. Thus, the B content is set to 0.0003% to 0.003% and preferably set 0.0005% to 0.002%.

N: 0.001 to 0.008%

N reacts with Al and thereby forms a precipitate. This makes crystal grains finer, which enhances base-material toughness. N is an element that is necessary for forming TiN, which suppresses an excessive increase in the size of the microstructure of a welded zone. Thus, the N content is set to 0.001% or more. However, if the N content exceeds 0.008%, base-material toughness and the toughness of a welded zone become significantly degraded. Thus, the upper limit is set to 0.008%.

$Ceq \leq 0.80$

If Ceq exceeds 0.80, weldability and the toughness of a welded zone become degraded. Thus, Ceq is set to 0.80 or less and is preferably set to 0.75 or less. Note that, $Ceq=[C]+[Mn]/6+[Cu+Ni]/15+[Cr+Mo+V]/5$. Each symbol of element represents its content (mass %) and is 0 when the element is not contained.

$HCS=5.5[C]^{4/3}+15[P]+0.90[Mn]+0.12[Ni]+0.53[Mo] \leq 2.5$, where [M] represents the content (mass %) of the element and is 0 when the element is not contained.

This parametric expression is a center-segregation zone hardness index consisting of components that are likely to concentrate in a center-segregation zone, which is obtained empirically. If the value of the parametric expression exceeds 2.5, CTOD characteristics become degraded. Therefore, the value of the parametric expression is set to 2.5 or less and is preferably set to 2.3 or less. Since a CTOD test examines a steel plate over its entire thickness, a test piece including a center segregation is evaluated in terms of toughness. If concentration of components due to center segregation is significant, a hardened zone is formed in a weld heat affected zone, which prevents a good measurement value from being observed.

Fundamental chemical compositions of embodiments of the present invention are described above. In order to further improve characteristics, one or more elements selected from Cr: 0.2% to 2.5%, Mo: 0.1% to 0.7%, V: 0.005% to 0.1%, Cu: 0.49% or less, Ti: 0.005% to 0.025%, and Ca: 0.0005% to 0.003% are added.

Cr: 0.2% to 2.5%

Cr is an element that is effective for increasing base-material strength when the amount of Cr added is 0.2% or more. However, addition of an excessive amount of Cr produces an adverse effect in terms of toughness. Thus, when Cr is added, the Cr content is set to 0.2% to 2.5%.

Mo: 0.1% to 0.7%

Mo is an element that is effective for increasing base-material strength when the amount of Mo added is 0.1% or more. However, addition of an excessive amount of Mo produces an adverse effect in terms of toughness. Thus, when Mo is added, the Mo content is set to 0.1% to 0.7% and is preferably 0.1% to 0.6%.

V: 0.005% to 0.1%

V is an element that is effective for increasing the strength and improving base-material toughness when the amount of V added is 0.005% or more. However, if the amount of V added exceeds 0.1%, toughness becomes degraded. Thus, when V is added, the V content is set to 0.005% to 0.1%.

Cu: 0.49% or less

Cu is an element having an effect of increasing the strength of steel. However, if the Cu content exceeds 0.49%, hot embrittlement is caused, which results in degradation of the surface quality of a steel plate. Thus, when Cu is added, the Cu content is set to 0.49% or less.

Ti: 0.005% to 0.025%

Ti precipitates as TiN upon solidification of molten steel, which suppresses an increase in the size of austenite in a welded zone and thereby contributes to enhancement of toughness in a welded zone. However, this effect is small if the amount of Ti added is less than 0.005%. On the other hand, if the amount of Ti added exceeds 0.025%, the size of TiN excessively increases and it becomes impossible to produce an effect of improving base-material toughness and the toughness of a welded zone. Thus, when Ti is added, the Ti content is set to 0.005% to 0.025%.

Ca: 0.0005% to 0.003%

Ca is an element that fixes S and thereby enhances toughness. In order to produce this effect, the amount of Ca added needs to be at least 0.0005%. However, if the Ca content exceeds 0.003%, the effect of Ca becomes saturated. Thus, when Ca is added, the Ca content is set to 0.0005% to 0.003%.

2. Hardness Distribution $HV_{max}/HV_{ave} \leq 1.35+0.006/C-t/750$, where C represents carbon content (mass %) and t represents plate thickness (mm)

$HV_{max}/HV_{ave}$ is a dimensionless parameter that represents the hardness of a center-segregation zone. If this value exceeds a value calculated by 1.35+0.006/C−t/750, the CTOD value becomes reduced. Thus, $HV_{max}/HV_{ave}$ is set to be 1.35+0.006/C−t/750 or less.

$HV_{max}$ represents the hardness of a center-segregation zone and is determined as the maximum value among values obtained by measuring a range of (plate thickness/10) mm including a center-segregation zone at intervals of 0.25 mm in the plate-thickness direction with a Vickers hardness tester (load: 10 kgf). $HV_{ave}$ represents an average hardness and is determined as the average of values obtained by measuring a range that extends from (plate thickness/4) mm below the front side to (plate thickness/4) below the back side and does not include the center-segregation zone at intervals of 1 to 2 mm at a load of 10 kgf with a Vickers hardness tester.

The steel according to the present invention is preferably produced by the method described below.

Molten steel having a chemical composition adjusted to be within the range of the present invention is prepared by an ordinal method using a converter, an electric furnace, a vacuum melting furnace, or the like and then formed into a slab through a step of continuous casting. Subsequently, the slab is hot-rolled to a desired plate thickness, cooled, and then subjected to a tempering treatment.

Slab-heating temperature: 1050° C. or more and rolling reduction ratio: 2 or more In the present invention, the slab-heating temperature and the rolling reduction ratio (=slab thickness/plate thickness) during hot rolling have little effect on the mechanical characteristics of a steel plate. However, in the case of a thick material, if the slab-heating temperature is too low or rolling reduction amount is insufficiently small, initial defects caused in production of steel ingot remain in the central portion of a steel plate in its thickness direction, which causes the internal quality of the steel plate to be significantly degraded. Thus, the slab-heating temperature is set to 1050° C. or more and the rolling reduction ratio is set to 2 or more in order to press-bonding such casting defects present in a slab by hot rolling with certainty.

It is not necessary to set the upper limit for the slab-heating temperature. However, heating temperature is preferably 1200° C. or less because heating at an excessive high temperature increases the size of a precipitate such as TiN precipitated upon solidification, which reduces base-material toughness and the toughness of a welded zone and because a thick scale is formed on the surface of steel slab at a high temperature, which causes occurrence of surface flaws during rolling. The above heating temperature is also preferable from the viewpoint of energy conservation.

Cooling after hot-rolling: to 350° C. or less at a cooling rate of 0.3° C./s or more If cooling rate is less than 0.3° C./s, sufficient base-material strength cannot be achieved. If cooling is stopped at a temperature higher than 350° C., γ-to-α transformation cannot be perfectly completed and high-temperature transformation structure is formed. As a result, high-tensile and high toughness cannot be achieved at the same time. Cooling rate is measured at the central portion of a steel plate in its thickness direction. The temperature at the central portion in the plate-thickness direction can be calculated from plate thickness, surface temperature, cooling conditions, and the like by simulation calculation or the like. For example, the temperature of the central portion in the plate-thickness direction is determined by calculating a temperature distribution in the plate-thickness direction by calculus of finite differences.

Reheating temperature after hot rolling 880° C. or more

If the reheating temperature is lower than 880° C., target strength and toughness are not achieved due to incomplete austenitization. Thus, the reheating temperature is set to 880° C. or more and is preferably set to 900° C. or more. The upper limit temperature for the reheating temperature is not particularly limited but is preferably set to 1000° C. or less because heating to an excessively high temperature causes the size of austenite grains to be increased, which leads to degradation of toughness.

Tempering temperature: 450° C. to 680° C.

If the tempering temperature is less than 450° C., the effect of tempering cannot be produced to a sufficient degree. On the other hand, if tempering is performed at a tempering temperature exceeding 680° C., a carbonitride having a large size is precipitated, which unfavorably degrades toughness. When tempering is performed by induction-heating, an increase in the size of carbide during tempering is favorably suppressed. In this case, a temperature at the center of the thickness of a steel plate, which is calculated by simulation such as calculus of finite differences, is set to 450° C. to 680° C.

Examples

Slabs prepared from Steel Nos. A to N having the chemical compositions shown in Table 1 by continuous casting were used as raw materials, and hot rolling and a heat treatment were performed under the conditions shown in Table 2. Thus, thick steel plates each having a thickness of 60 to 150 mm were prepared.

A method for evaluating a base material was as follows. In a tensile test, a JIS No. 4 test piece was taken from a ½ portion of a steel plate in its thickness direction so that the longitudinal direction of the test piece was perpendicular to the roll direction of the steel plate. Then, the yield point and tensile strength of the test piece were measured.

In a Charpy impact test, a JIS V-notch test piece was taken from a ½ portion of a steel plate in its thickness direction so that the longitudinal direction of the test piece was perpendicular to the roll direction of the steel plate. Then, the absorption energy at −40° C. (vE−40° C.) of the test piece was measured. The base-material properties were evaluated as good when YP≥620 MPa, TS≥720 MPa, and vE−40° C.≥100 J were all satisfied.

In the evaluation of welded zone toughness, a multipass welded joint was formed by submerged arc welding at a welding heat input of 45 to 50 kJ/cm using a double bevel groove. Absorption energy at −40° C. was measured by setting a notch position for a Charpy impact test at a weld bonded portion located on the straight-side of a ¼ portion of a steel plate. The toughness of a welded zone joint was evaluated as good when the average of three test pieces satisfied vE−40° C.≥100 J.

In addition, a CTOD value at −10° C. was measured by setting a notch position for a three-point bending CTOD test piece at a weld bonded portion located on the straight-side. The CTOD characteristics of a welded joint was evaluated as good when the minimum CTOD value among three test pieces was 0.50 mm or more.

Steels A to E and N were Invention Examples and Steels F to M were Comparative Examples that did not meet the ranges of components specified in Claims. In Examples 1, 2, 5, 6, 10, 11, and 20, the components and manufacturing conditions according to the present invention were satisfied, and good base-material properties and CTOD characteristics were produced. Moreover, vE−40° C.≥100 J was satisfied.

On the other hand, in Example 3, in which air-cooling was performed subsequent to reheating, target base-material strength was not produced since a cooling rate was less than 0.3° C./s. In Example 4, target base-material strength and toughness were not produced since the cooling-stop temperature exceeded 350° C. In Example 8, target base-material strength and toughness were not produced since the heating temperature was less than 880° C. In Example 9, target base-material strength and toughness were not produced since the tempering temperature was less than 450° C. In Example 7, target base-material toughness and the CTOD value of a welded zone were not produced since the rolling reduction ratio was less than 2.

In Example 12, target base-material toughness was not produced since the amount of C added was less than the lower limit specified in the present invention. In Example 14, a target CTOD value of a welded zone was not produced since the amount of Ni added was less than the lower limit specified in the present invention.

In Examples 13, 15, 17, and 19, the amounts of C, Ceq, Mn, and P, respectively, exceeded the upper limit preferred in the present invention, and the value of HV max/HV ave did not meet the range preferred in the present invention. As a result, a target CTOD value of a welded zone was not produced.

In Example 16, although the amount of each component fell within the range preferred in the present invention range, a center-segregation zone hardness index $HCS=5.5[C]^{4/3}+15[P]+0.90[Mn]+0.12[Ni]+0.53[Mo]\leq 2.5$ was not satisfied. As a result, a target weld portion CTOD value was not produced.

In Example 18, target base-material strength and toughness were not produced since the amount of B added was less than the lower limit preferred in the present invention.

A CTOD test and a Charpy test for a welded zone were not carried out in Examples 3, 4, 8, 9, 12, and 18, for target base-material strength and toughness were not scored.

TABLE 1

(mass %)

| Steel | C | Si | Mn | P | S | Cu | Ni | Cr | Mo | V | Ti | B |
|---|---|---|---|---|---|---|---|---|---|---|---|---|
| A | 0.125 | 0.25 | 1.86 | 0.006 | 0.0004 | 0.02 | 1.26 | 0.03 | 0.02 | 0.001 | | 0.0011 |
| B | 0.070 | 0.19 | 1.66 | 0.007 | 0.0007 | 0.02 | 1.89 | 0.75 | 0.45 | 0.041 | 0.009 | 0.0013 |
| C | 0.082 | 0.12 | 0.95 | 0.007 | 0.0010 | 0.33 | 2.13 | 0.03 | 0.46 | 0.041 | | 0.0012 |
| D | 0.113 | 0.25 | 1.45 | 0.007 | 0.0012 | 0.26 | 1.15 | 0.60 | 0.44 | 0.003 | 0.018 | 0.0013 |
| E | 0.072 | 0.07 | 0.86 | 0.007 | 0.0023 | 0.01 | 0.95 | 2.20 | 0.12 | 0.002 | 0.022 | 0.0015 |
| F | 0.040 | 0.28 | 0.88 | 0.006 | 0.0010 | 0.26 | 0.78 | 0.02 | 0.44 | 0.042 | | 0.0012 |
| G | 0.148 | 0.28 | 1.15 | 0.007 | 0.0008 | 0.01 | 0.89 | 0.70 | 0.65 | 0.002 | 0.015 | 0.0010 |
| H | 0.121 | 0.25 | 1.24 | 0.004 | 0.0008 | 0.35 | 0.42 | 0.60 | 0.55 | 0.040 | | 0.0014 |
| I | 0.125 | 0.28 | 1.66 | 0.005 | 0.0025 | 0.03 | 1.46 | 0.86 | 0.68 | 0.058 | | 0.0012 |
| J | 0.096 | 0.25 | 2.25 | 0.004 | 0.0009 | 0.26 | 1.16 | 0.32 | 0.45 | 0.041 | 0.016 | 0.0012 |
| K | 0.054 | 0.13 | 2.42 | 0.004 | 0.0006 | 0.22 | 0.55 | 0.21 | 0.01 | 0.041 | 0.016 | 0.0012 |
| L | 0.057 | 0.13 | 1.58 | 0.004 | 0.0007 | 0.26 | 1.17 | 0.60 | 0.44 | 0.041 | 0.016 | 0.0001 |
| M | 0.094 | 0.25 | 1.85 | 0.011 | 0.0029 | 0.04 | 0.66 | 0.83 | 0.52 | 0.055 | | 0.0009 |
| N | 0.059 | 0.23 | 1.05 | 0.003 | 0.0011 | 0.12 | 3.48 | 0.44 | 0.61 | 0.035 | | 0.0015 |

TABLE 1-continued (mass %)

| Steel | Sol.Al | N | Ca | O | Ceq | HCS | Remark |
|---|---|---|---|---|---|---|---|
| A | 0.059 | 0.0040 | | 0.0025 | 0.531 | 2.27 | Invention Example |
| B | 0.032 | 0.0030 | 0.0022 | 0.0024 | 0.722 | 2.22 | Invention Example |
| C | 0.059 | 0.0027 | | 0.0033 | 0.511 | 1.66 | Invention Example |
| D | 0.053 | 0.0065 | 0.0025 | 0.0028 | 0.657 | 2.08 | Invention Example |
| E | 0.022 | 0.0035 | 0.0016 | 0.0037 | 0.744 | 1.22 | Invention Example |
| F | 0.053 | 0.0025 | | 0.0022 | 0.356 | 1.28 | Comparative Example |
| G | 0.015 | 0.0055 | | 0.0024 | 0.670 | 2.02 | Comparative Example |
| H | 0.017 | 0.0043 | | 0.0029 | 0.617 | 1.85 | Comparative Example |
| I | 0.062 | 0.0027 | | 0.0035 | 0.821 | 2.45 | Comparative Example |
| J | 0.016 | 0.0042 | | 0.0037 | 0.728 | 2.70 | Comparative Example |
| K | 0.005 | 0.0042 | | 0.0028 | 0.561 | 2.42 | Comparative Example |
| L | 0.015 | 0.0042 | | 0.0036 | 0.632 | 1.98 | Comparative Example |
| M | 0.066 | 0.0032 | | 0.0028 | 0.730 | 2.42 | Comparative Example |
| N | 0.067 | 0.0035 | 0.0021 | 0.0012 | 0.691 | 1.86 | Invention Example |

Note 1:

underlinedpart is out of the range of the present invention

Note 2:

Ceq = C + Mn/6 + Cu/15 + Ni/15 + Cr/5 + Mo/5 + V/5 each element symbol represents the content (mass %) of the element Note 3:

HCS = $5.5[C]^{4/3} + 15[P] + 0.90[Mn] + 0.12[Ni] + 0.53[Mo]$ [M] represents the content (mass %) of the element, and the range of the present invention ≤2.5

TABLE 2

| | | | Rolling conditions | | | Reheating-cooling conditions | | | |
|---|---|---|---|---|---|---|---|---|---|
| No | Steel No. | Steel slab thickness (mm) | Heating temperature (° C.) | Steel plate thickness (mm) | Rolling reduction ratio | Temperature (° C.) | Cooling rate (° C./s) | Cooling-stop temperature (° C.) | Tempering temperature (° C.) |
| 1 | A | 250 | 1120 | 75 | 3.3 | 930 | 3 | ≤250 | 650 |
| 2 | B | 250 | 1120 | 100 | 2.5 | 930 | 2 | ≤250 | 610 |
| 3 | B | 250 | 1120 | 100 | 2.5 | 930 | 0.1 | ≤250 | 610 |
| 4 | B | 250 | 1120 | 100 | 2.5 | 930 | 2 | 480 | 610 |
| 5 | C | 250 | 1120 | 60 | 4.2 | 930 | 6 | ≤250 | 620 |
| 6 | D | 250 | 1120 | 100 | 2.5 | 930 | 2 | ≤250 | 650 |
| 7 | D | 250 | 1120 | 150 | 1.7 | 930 | 0.9 | ≤250 | 600 |
| 8 | D | 250 | 1120 | 100 | 2.5 | 850 | 2 | ≤250 | 630 |
| 9 | D | 250 | 1120 | 100 | 2.5 | 930 | 2 | ≤250 | 410 |
| 10 | E | 300 | 1120 | 100 | 3.0 | 930 | 2 | ≤250 | 670 |
| 11 | E | 300 | 1120 | 130 | 2.3 | 930 | 0.9 | ≤250 | 630 |
| 12 | F | 250 | 1120 | 100 | 2.5 | 930 | 2 | ≤250 | 630 |
| 13 | G | 250 | 1120 | 100 | 2.5 | 930 | 2 | ≤250 | 630 |
| 14 | H | 250 | 1120 | 100 | 2.5 | 930 | 2 | ≤250 | 630 |
| 15 | I | 250 | 1120 | 100 | 2.5 | 930 | 2 | ≤250 | 630 |
| 16 | J | 250 | 1120 | 100 | 2.5 | 930 | 2 | ≤250 | 610 |
| 17 | K | 250 | 1120 | 100 | 2.5 | 930 | 2 | ≤250 | 630 |
| 18 | L | 250 | 1120 | 100 | 2.5 | 930 | 2 | ≤250 | 630 |
| 19 | M | 250 | 1120 | 100 | 2.5 | 930 | 2 | ≤250 | 650 |
| 20 | N | 300 | 1150 | 150 | 2.0 | 910 | 1 | ≤250 | 675 |

| | Base-material properties | | | | | Welded portion toughness | | |
|---|---|---|---|---|---|---|---|---|
| No | YP (MPa) | TS (MPa) | vE-40° C. (J) | 1.35 + 0.006/C.-t/750 | HV max/HV ave | vE-40° C. (J) | CTOD δ-10° C. (mm) | Remark |
| 1 | 746 | 812 | 215 | 1.30 | 1.25 | 176 | 0.91 | Invention Example |
| 2 | 822 | 884 | 198 | 1.30 | 1.24 | 189 | 0.76 | Invention Example |
| 3 | 612 | 724 | 233 | 1.30 | | | | Comparative Example |
| 4 | 587 | 695 | 86 | 1.30 | | | | Comparative Example |
| 5 | 706 | 811 | 177 | 1.34 | 1.23 | 213 | 1.23 | Invention Example |
| 6 | 774 | 865 | 189 | 1.27 | 1.25 | 167 | 0.87 | Invention Example |
| 7 | 722 | 815 | 96 | 1.20 | 1.32 | 176 | 0.28 | Comparative Example |
| 8 | 624 | 730 | 44 | 1.27 | | | | Comparative Example |
| 9 | 634 | 916 | 48 | 1.27 | | | | Comparative Example |
| 10 | 735 | 817 | 188 | 1.30 | 1.24 | 166 | 1.05 | Invention Example |
| 11 | 723 | 805 | 198 | 1.26 | 1.21 | 168 | 0.79 | Invention Example |
| 12 | 656 | 764 | 35 | 1.37 | | | | Comparative Example |
| 13 | 769 | 894 | 208 | 1.26 | 1.31 | 178 | 0.38 | Comparative Example |
| 14 | 744 | 870 | 167 | 1.27 | 1.17 | 32 | 0.46 | Comparative Example |
| 15 | 875 | 962 | 175 | 1.26 | 1.28 | 55 | 0.40 | Comparative Example |

TABLE 2-continued

| | | | | | | | | |
|---|---|---|---|---|---|---|---|---|
| 16 | 739 | 820 | 166 | 1.28 | 1.42 | | 0.31 | Comparative Example |
| 17 | 685 | 793 | 159 | 1.33 | 1.43 | 185 | 0.33 | Comparative Example |
| 18 | 558 | 678 | 24 | 1.32 | | | | Comparative Example |
| 19 | 768 | 872 | 169 | 1.28 | 1.31 | 164 | 0.43 | Comparative Example |
| 20 | 706 | 792 | 178 | 1.25 | 1.21 | 154 | 2.14 | Invention Example |

Note 1:
underlinedpart is out of the range of the present invention

The invention claimed is:

1. A high-tensile steel plate giving welding heat-affected zone with excellent low-temperature toughness, the high-tensile steel plate comprising a chemical composition containing, by mass, C: 0.05% to 0.14%, Si: 0.01% to 0.30%, Mn: 0.3% to 2.3%, P: 0.008% or less, S: 0.005% or less, Al: 0.22% to 0.1%, Ni: 0.5% to 4%, B: 0.0003% to 0.003%, N: 0.001% to 0.008%, Ceq (=[C]+[Mn]/6+[Cu+Ni]/15+[Cr+Mo+V]/5, each element symbol represents the content (mass %) of the element)≤0.80, a center-segregation zone hardness index HCS satisfying Expression (1), and the balance being Fe and inevitable impurities, wherein the hardness of a center-segregation zone in the steel plate satisfies Expression (2), $$HCS=5.5[C]^{4/3}+15[P]+0.90[Mn]+0.12[Ni]+0.53[Mo]\leq 2.5 \quad (1)$$

where each [M] represents the content (mass %) of the element, $$HV_{max}/HV_{ave}\leq 1.35+0.006/C-t/750 \quad (2)$$

where $HV_{max}$ represents a maximum Vickers hardness of the center-segregation zone, $HV_{ave}$ represents an average Vickers hardness of a portion that does not include the center-segregation zone and that does not include regions extending from both surfaces to ¼ of the thickness of the steel plate, C represents the content (mass %) of carbon, and t represents a thickness (mm) of the steel plate.

2. The high-tensile steel plate giving welding heat-affected zone with excellent low-temperature toughness according to claim 1, the chemical composition of the steel plate further containing one or more elements selected from, by mass, Cr: 0.2% to 2.5%, Mo: 0.1% to 0.7%, V: 0.005% to 0.1%, and Cu: 0.49% or less.

3. The high-tensile steel plate giving welding heat-affected zone with excellent low-temperature toughness according to claim 1, the chemical composition of the steel plate further containing one or more elements selected from, by mass, Ti: 0.005% to 0.025% and Ca: 0.0005% to 0.003%.

4. A method for producing a high-tensile steel plate giving welding heat-affected zone with excellent low-temperature toughness, the method comprising heating a steel having the chemical composition according to claim 1 to 1050° C. or more, performing hot rolling at a rolling reduction ratio of 2 or more, performing reheating to 880° C. or more, performing cooling at a cooling rate of 0.3° C./s or more until a temperature of a central portion in a plate-thickness direction reaches 350° C. or less, and performing a tempering treatment at 450° C. to 680° C.

5. A method for producing a high-tensile steel plate giving welding heat-affected zone with excellent low-temperature toughness, the method comprising heating a steel having the chemical composition according to claim 3 to 1050° C. or more, performing hot rolling at a rolling reduction ratio of 2 or more, performing reheating to 880° C. or more, performing cooling at a cooling rate of 0.3° C./s or more until a temperature of a central portion in a plate-thickness direction reaches 350° C. or less, and performing a tempering treatment at 450° C. to 680° C.

6. The high-tensile steel plate giving welding heat-affected zone with excellent low-temperature toughness according to claim 2, the chemical composition of the steel plate further containing one or more elements selected from, by mass, Ti: 0.005% to 0.025% and Ca: 0.0005% to 0.003%.

7. A method for producing a high-tensile steel plate giving welding heat-affected zone with excellent low-temperature toughness, the method comprising heating a steel having the chemical composition according to claim 2 to 1050° C. or more, performing hot rolling at a rolling reduction ratio of 2 or more, performing reheating to 880° C. or more, performing cooling at a cooling rate of 0.3° C./s or more until a temperature of a central portion in a plate-thickness direction reaches 350° C. or less, and performing a tempering treatment at 450° C. to 680° C.

8. The high-tensile steel plate giving welding heat-affected zone with excellent low-temperature toughness according to claim 1, wherein the steel plate has a thickness of 50 to 210 mm.

* * * * *